US008360142B2

(12) United States Patent
Durst et al.

(10) Patent No.: US 8,360,142 B2
(45) Date of Patent: Jan. 29, 2013

(54) HIGH-RATIO TUBULAR EXPANSION

(75) Inventors: Douglas Glenn Durst, Houston, TX (US); Adam Darius Johnson, III, Houston, TX (US); Gregory Marshall Noel, Houston, TX (US)

(73) Assignee: Enventure Global Technology, LLC, Houston, TX (US)

( * ) Notice: Subject to any disclaimer, the term of this patent is extended or adjusted under 35 U.S.C. 154(b) by 324 days.

(21) Appl. No.: 12/815,089

(22) Filed: Jun. 14, 2010

(65) Prior Publication Data

US 2010/0314130 A1 Dec. 16, 2010

Related U.S. Application Data

(60) Provisional application No. 61/186,944, filed on Jun. 15, 2009.

(51) Int. Cl.
*E21B 23/00* (2006.01)

(52) U.S. Cl. ..... 166/207; 166/384; 166/387

(58) Field of Classification Search ..... 166/191, 166/206, 208, 384, 387, 207
See application file for complete search history.

(56) References Cited

U.S. PATENT DOCUMENTS 4,976,322 A * 12/1990 Abdrakhmanov et al. ..... 175/57
6,497,289 B1 12/2002 Cook
6,530,574 B1 3/2003 Bailey et al.
6,854,522 B2 * 2/2005 Brezinski et al. ..... 166/387
7,048,067 B1 * 5/2006 Cook et al. ..... 166/380
7,100,684 B2 9/2006 Cook
7,252,142 B2 * 8/2007 Brezinski et al. ..... 166/191
7,350,563 B2 4/2008 Brisco
7,357,188 B1 4/2008 Cook
7,451,811 B2 11/2008 Lohbeck
7,757,774 B2 * 7/2010 Ring ..... 166/380
2002/0162664 A1 * 11/2002 Bode et al. ..... 166/380
2004/0231838 A1 * 11/2004 Carmody et al. ..... 166/207
2005/0077052 A1 * 4/2005 Ohmer ..... 166/384
2009/0205843 A1 * 8/2009 Gandikota et al. ..... 166/387
2009/0308594 A1 12/2009 Lohbeck
2010/0193199 A1 8/2010 Lohbeck

* cited by examiner

*Primary Examiner* — Kenneth L Thompson

(74) *Attorney, Agent, or Firm* — Derek V. Forinash; Porter Hedges LLP

(57) ABSTRACT

A system comprising a first expandable tubular section and a first expansion bridge coupled to an inner surface of the first expandable tubular section. A base pipe is coupled to the first expandable tubular section and to a second expandable tubular section. A second expansion bridge is coupled to an inner surface of the second expandable tubular section. The system also comprises an expansion cone disposed within and translatable relative to the first expandable section. The expansion cone has an expansion diameter greater than an inner diameter of the first and second expansion bridges and less than an inner diameter of the base pipe.

18 Claims, 2 Drawing Sheets

HIGH-RATIO TUBULAR EXPANSION

CROSS-REFERENCE TO RELATED APPLICATIONS

This application claims the benefit of U.S. provisional application Ser. No. 61/186,944, filed Jun. 15, 2009 and entitled "High-ratio Tubular Expansion," which is hereby incorporated herein by reference in its entirety for all purposes.

TECHNICAL FIELD

This disclosure relates generally to hydrocarbon exploration and production, and in particular to forming well bore tubular strings to facilitate hydrocarbon production or downhole fluid injection.

During hydrocarbon exploration and production, a well bore typically traverses a number of zones within a subterranean formation. A tubular system may be established in the wellbore to create flow paths from the multiple producing zones to the surface of the wellbore. Efficient production is highly dependent on the inner diameter of the tubular production system, with greater inner diameters producing more hydrocarbons or allowing inserted equipment with appropriate pressure ratings to be used in well completions. Existing apparatus and methods for producing hydrocarbons include a complex set of tubulars, connections, liner hangers, sand control devices, packers and other equipment which tend to constrict the inner diameter of the production system available for production. Further, as the diameter of the wellbore systems increases, the difficulty of installing these systems increases.

The principles of the present disclosure are directed to overcoming one or more of the limitations of the existing apparatus and processes for increasing fluid injection or hydrocarbon production during treatment, completion and production of subterranean wells.

BRIEF DESCRIPTION OF DRAWINGS

For a more detailed description of the embodiments of the present disclosure, reference will now be made to the accompanying drawings, wherein.

DESCRIPTION OF EMBODIMENTS

Figure 1:
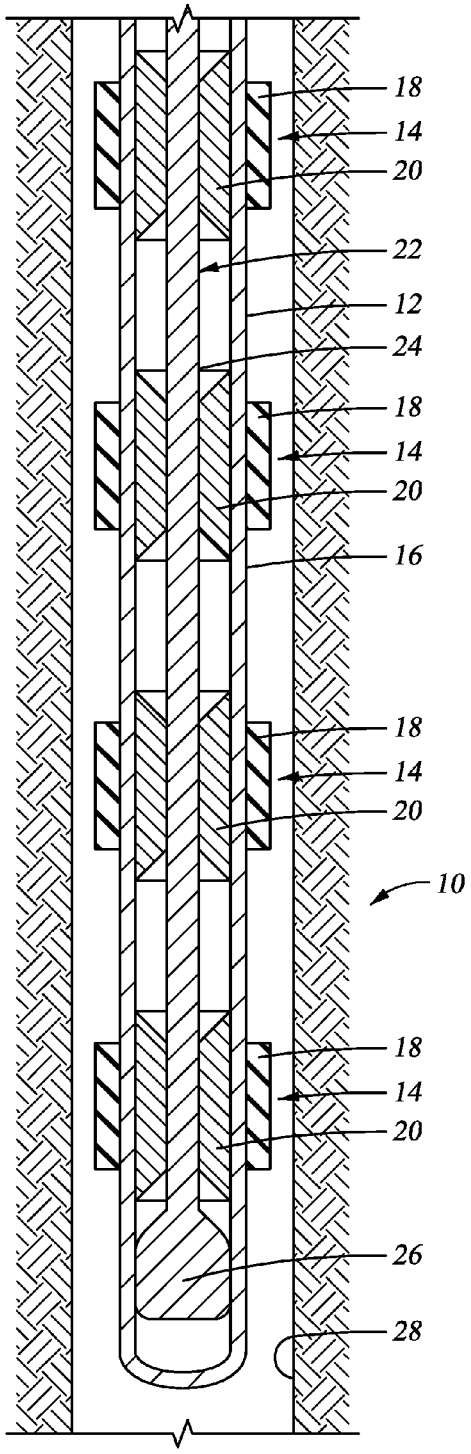
FIG. 1 is a schematic, partial section view of one embodiment of a system utilizing internal expansion bridges shown in a run-in configuration.

In the drawings and description that follow, like parts are typically marked throughout the specification and drawings with the same reference numerals. The drawing figures are not necessarily to scale. Certain features of the invention may be shown exaggerated in scale or in somewhat schematic form and some details of conventional elements may not be shown in the interest of clarity and conciseness. The present disclosure is susceptible to embodiments of different forms. Specific embodiments are described in detail and are shown in the drawings, with the understanding that the present disclosure is to be considered an exemplification of the principles of the invention, and is not intended to limit the invention to that illustrated and described herein. It is to be fully recognized that the different teachings of the embodiments discussed below may be employed separately or in any suitable combination to produce desired results.

Unless otherwise specified, any use of any form of the terms "connect", "engage", "couple", "attach", or any other term describing an interaction between elements is not meant to limit the interaction to direct interaction between the elements and may also include indirect interaction between the elements described. In the following discussion and in the claims, the terms "including" and "comprising" are used in an open-ended fashion, and thus should be interpreted to mean "including, but not limited to . . . ". The terms "pipe," "tubular member," "casing" and the like as used herein shall include tubing and other generally cylindrical objects. In addition, in the discussion and claims that follow, it may be sometimes stated that certain components or elements are in fluid communication. By this it is meant that the components are constructed and interrelated such that a fluid could be communicated between them, as via a passageway, tube, or conduit. The various characteristics mentioned above, as well as other features and characteristics described in more detail below, will be readily apparent to those skilled in the art upon reading the following detailed description of the embodiments, and by referring to the accompanying drawings.

Referring initially to FIG. 1, system 10 comprises base pipe 12 and a plurality of expandable tubular sections 14. Each expandable tubular section 14 comprises an expandable tubular 16 to which are coupled an external seal 18 and an internal expansion bridge 20. In certain embodiments, system 10 also comprises a shoe 29 coupled to an end of the system. Shoe 29 comprises valves that enable the circulation of fluid through system 10 while running the system into the wellbore or during cementing operations. System 10 may comprise any number of expandable tubular sections 14 separated by base pipes 12.

External seal 18 is coupled to an outer surface of expandable tubular 16 and comprises a sealing member that is operable to sealingly engage wellbore 28. External seal 18 may comprise a resilient sealing member and in some embodiments may comprise a swellable elastomer, which increases in volume in the presence of selected fluids. Certain embodiments of expandable tubular section 14 may not comprise an external seal 18 and may be expanded directly into contact with wellbore 28.

Internal expansion bridge 20 is coupled to an inner surface of expandable tubular 16 and comprises a material which can transfer expansion forces to the expandable tubular and can radially deform as the expandable tubular is expanded. In certain embodiments, internal expansion bridge may be comprise a resilient material, such as polyurethane, or non-resilient material, such as a sprayed metal, that is bonded or coupled to the inside diameter of expandable tubular 16.

Once deployed at a desired depth within the wellbore, each expandable tubular section 14 can be expanded by expansion system 22, which comprises workstring 24 and expansion cone 26. In certain embodiments, expansion cone 26 has a diameter substantially equal to the inner diameter of base pipe 12. Expansion cone 26 may be a solid cone having a fixed expansion diameter or an adjustable cone with an adjustable expansion diameter as are known in the art. Expansion system 22 may be deployed with expandable system 10 or separately deployed with coiled tubing, wireline, or other means, once expandable system has been disposed in a wellbore.

Figure 2:
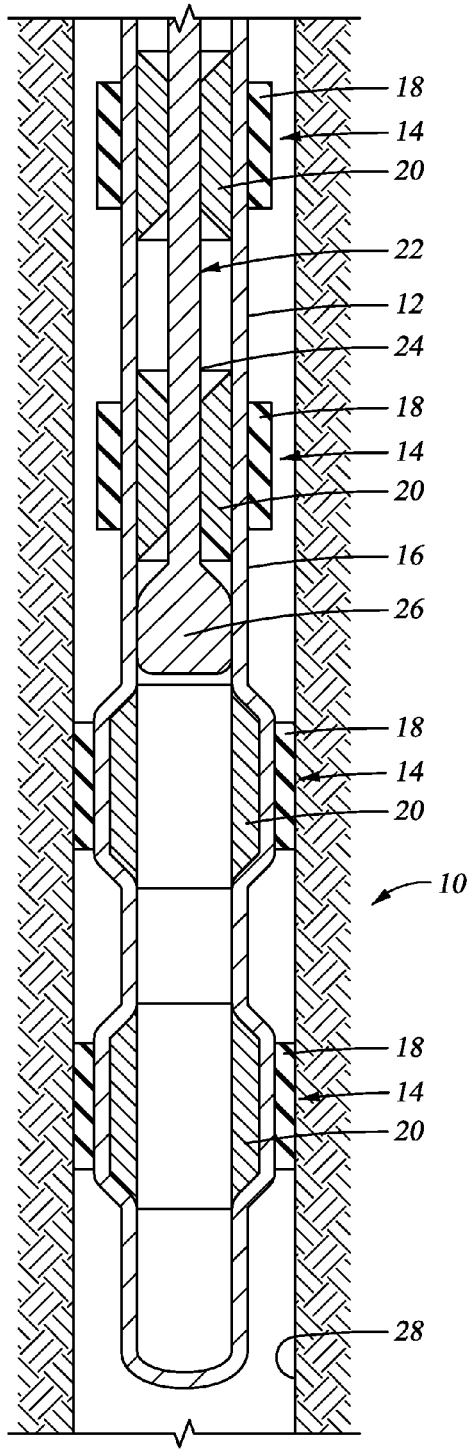
FIG. 2 is the system of FIG. 1 shown in an expanded position.

Referring now to FIG. 2, system 10 and expansion system 22 are shown disposed within wellbore 28 in an as-run condition. In the as-run condition, expandable sections 14 are not expanded and system 10 is not sealingly engaged with wellbore 28. System 10 is set within wellbore 28 by activating expansion system 22 so as to move expansion cone 26 longitudinally through system 10. Expansion system 22 can be activated by applying pressurized fluid to push cone 26, applying tension to workstring 24 to pull cone 26, a combination of the two, or any other means.

As expansion cone 26 moves through system 10, it will pass through base pipe 12 without expanding the base pipe. When moving through expandable sections 14, cone 26 will radially expand internal expansion bridge 20 and expandable tubular 16. This radial expansion moves external seal 18 outward so as to compress the external seal between tubular 16 and wellbore 28. Internal expansion bridges 20 may be bonded or coupled to the expandable tubular 16 such that once cone 26 passes through the bridge, the internal diameter of the bridge is substantially equal to the internal diameter of the expanded tubular.

Figure 3:
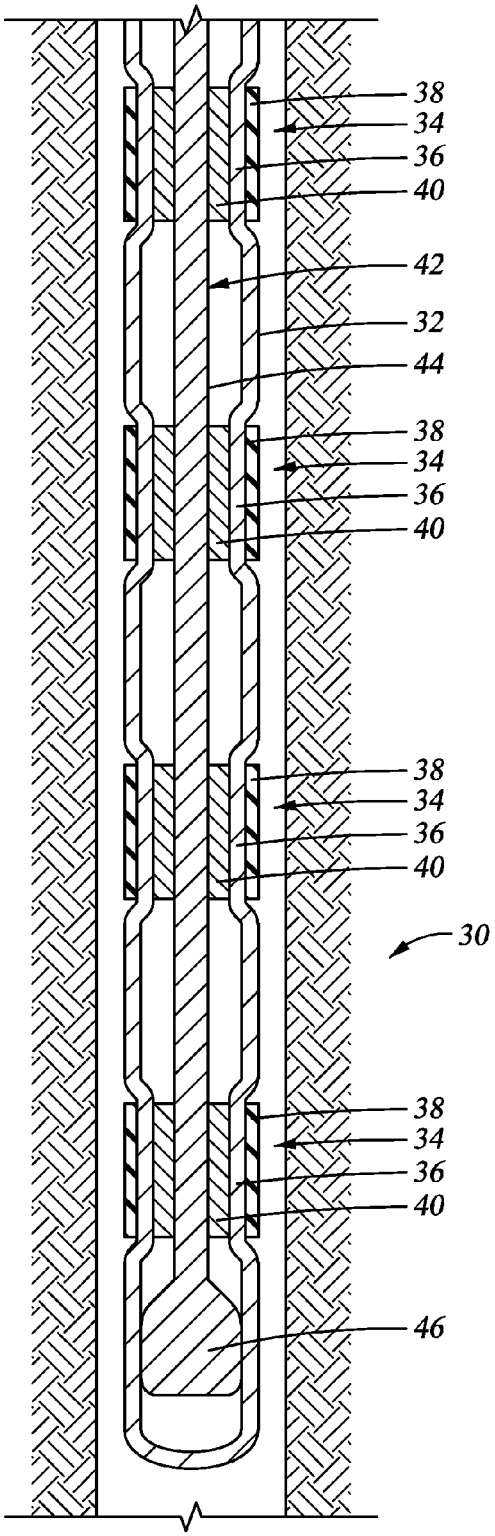
FIG. 3 is a schematic, partial section view of another embodiment of a system utilizing internal expansion bridges shown in a run-in configuration.
Figure 4:
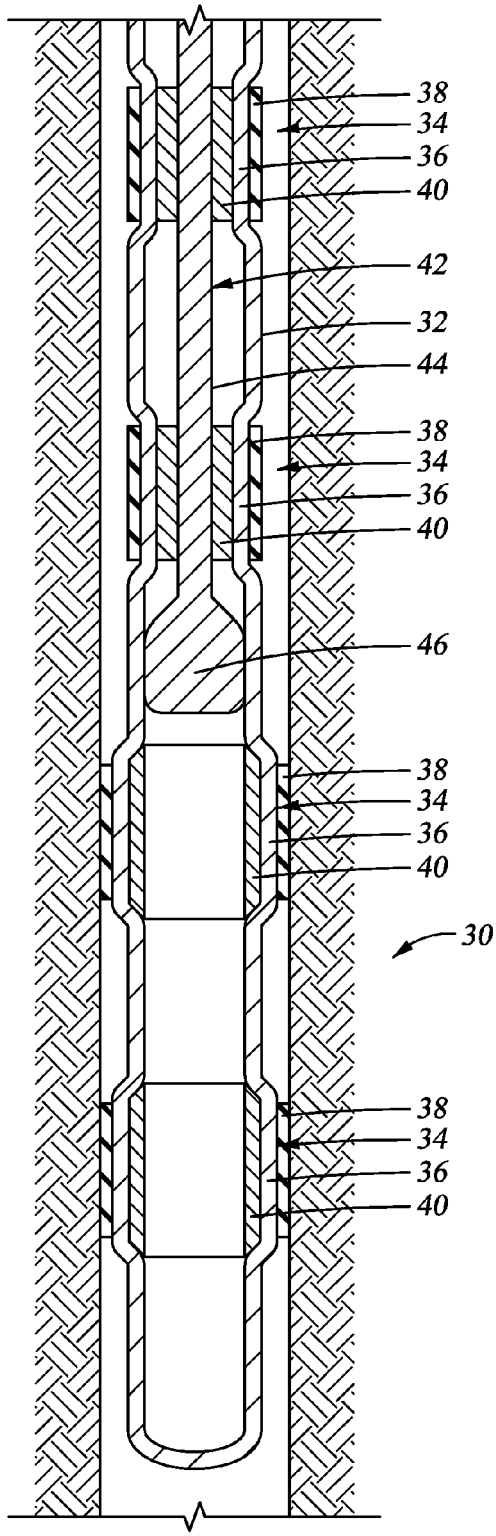
FIG. 4 is the system of FIG. 3 shown in an expanded position.

Referring now to FIGS. 3 and 4, an alternate system 30 is shown comprising base pipe 32 and a plurality of expandable sections 34. Each expandable section 34 comprises an expandable tubular 36 to which is coupled an external seal 38. The expandable section 34 has a reduced outer diameter that is smaller than base pipe 32. This allows external seal 38 to be protected while system 30 is being run into a wellbore and further reduces the drift diameter needed to successfully run the system.

Expandable sections 34 may also have an internal expansion bridge 40 that comprises a material which can transfer expansion forces to expandable tubular 36 and can radially deform as the expandable tubular is expanded. In certain embodiments, internal expansion bridge 40 may be comprise a resilient material, such as polyurethane, or non-resilient material, such as a sprayed metal, that is bonded or coupled to the inside diameter of expandable tubular 36.

As shown in FIG. 4, an expansion system 42, comprising workstring 44 and expansion cone 46, is disposed within system 30. Expansion system 42 is activated and cone 46 moves longitudinally through system 30. As expansion cone 46 passes through expandable sections 34, cone 46 will radially expand internal expansion bridge 40 and expandable tubular 36. This radial expansion moves external seal 38 outward so as to compress the external seal between tubular 36 and wellbore 48. Internal expansion bridges 30 may be bonded or coupled to the expandable tubular 36 such that once cone 46 passes through the bridge, the internal diameter of the bridge is substantially equal to the internal diameter of the expanded tubular.

As described above, the use of an internal expansion bridge allows expansion of a tubular member to an inner diameter that is greater than the diameter of the expansion cone being used. Thus, the systems disclosed herein provide an apparatus having a relatively small diameter while being run but having the capability to expand and sealingly engage a larger diameter wellbore (a high ratio of expansion). Reducing the outer diameter of systems being run into a wellbore increases the chances of being able to place the system at the desired depth in the wellbore by minimizing risk associated with low running clearances, wellbore tortuousity, etc. These systems also provide a through bore having a constant diameter, which may be advantageous in certain situations.

An internal expansion bridge may also serve to protect the tubular being expanded from the expansion cone during the expansion process. The expansion bridge could then be removed from inside the expanded tubular. For example, an internal expansion bridge could line the interior of an expandable polished bore receptacle (PBR). During the expansion of the PBR, the inside diameter of the PBR would be protected from contact with the expansion cone. Once expansion was complete, the internal expansion bridge could be removed and the PBR used as designed. In other embodiments, an internal expansion bridge could be utilized in the expansion of a landing nipple, sliding sleeve, locking profile, or other downhole component.

In certain embodiments, the internal expansion bridge provides means to transfer loads from one member to another member so as to enable changes in shape or form. The material may be able to be inserted, stretched, expanded, extended, scoped, stacked, banded, overlapped, overlayed, sleeved, bonded, attached, etc. and that allows a transfer, transition, amplification, regression or progression of motion or movement by means of force, pressure, temperature, chemical change or combinations thereof from one member to another member to create a change in shape, form or condition to one of the members.

The internal expansion bridge may comprise a material that expands with the expandable member with little or no regression in size, i.e. a permanent deformation, a material that expands with the expandable member and returns to original or near original condition to be retrieved or removed from the wellbore, a material that expands an expandable member to form a profile or shape within the expandable member and is then removed from the expandable member to provide means to locate secondary tools or devices within the expandable member profile or shape, a material that expands an expandable member with a sealing or finished surface with or without a corresponding profile or shape to provide a subsurface or surface polished bore or tie back receptacle for landing, sealing, anchoring, latching, locking other device for purposes of creating a contiguous conduit or a retrievable or permanent barrier, or any combination of the above. In certain embodiments, the internal expansion bridge may be a metallic or non-metallic material that provides means to expand another member to a greater diameter or shape (i) without imposing or creating further restriction or reduction to the internal diameter of the expanded member; (ii) while maintaining the original geometrical shape or shapes in the expanded member, including but not limited to profiles, threads, seal bores, etc.; or (iii) while changing the geometrical shape or shapes of the expanded material, including but not limited to profiles, threads, grooves, etc.

In certain embodiments, a downhole system utilizing an internal expansion bridge may comprise a device that can be expanded by an expansion member, and that utilizes a series of laminated or layered materials that could be either similar or dissimilar in mechanical or chemical structure. In some embodiments, the downhole system may comprise a device that can be expanded by an expansion member, and that utilizes a series of laminated or layered materials that could be either similar or dissimilar in mechanical or chemical structure and said device can provide means to seal and anchor, barrier, hanger, packer, etc. within an open or cased wellbore. In some embodiments, the downhole system may comprise a device that can be expanded by an expansion member, and that utilizes a series of laminated or layered materials that could be either similar or dissimilar in mechanical or chemical structure and said device can provide means to locate, land, lock, seal, house, accommodate secondary devices such as but not limited to plugs, barrier devices, flow control devices, sealing devices, monitoring devices, etc. In other embodiments, the downhole system may comprise a device that can be expanded by an expansion member, and that utilizes a series of laminated or layered materials that could be either similar or dissimilar in mechanical or chemical structure and said device can provide a sealing surface for means to accommodate seal devices to locate and seal within the said device to provide a contiguous conduit.

While the disclosure is susceptible to various modifications and alternative forms, specific embodiments thereof are shown by way of example in the drawings and description. It should be understood, however, that the drawings and detailed description thereto are not intended to limit the disclosure to the particular form disclosed, but on the contrary, the intention is to cover all modifications, equivalents and alternatives falling within the spirit and scope of the present disclosure.

What is claimed is:

1. A system comprising:

a first expandable tubular section;

a first expansion bridge coupled to an inner surface of said first expandable tubular section;

a base pipe having a first end coupled to said first expandable tubular section;

a second expandable tubular section coupled to a second end of said base pipe;

a second expansion bridge coupled to an inner surface of said second expandable tubular section;

an expansion cone disposed within and translatable relative to said first expandable section, wherein said expansion cone has an expansion diameter greater than an inner diameter of said first and second expansion bridges and less than an inner diameter of said base pipe a first external seal coupled to an outer surface of the first expandable tubular section; and a second external seal coupled to an outer surface of the second expandable tubular section.

2. The system of claim 1 wherein said first and second external seals comprise a swellable elastomer.

3. The system of claim 1, wherein the expansion diameter of said expansion cone is fixed.

4. The system of claim 1, wherein said base pipe has an inner diameter that is greater than an unexpanded inner diameter of said first expandable tubular section.

5. A system comprising:

a first expandable tubular section;

a first expansion bridge coupled to an inner surface of said first expandable tubular section;

a base pipe having a first end coupled to said first expandable tubular section;

a second expandable tubular section coupled to a second end of said base pipe;

a second expansion bridge coupled to an inner surface of said second expandable tubular section; and an expansion cone disposed within and translatable relative to said first expandable section, wherein said expansion cone has an expansion diameter greater than an inner diameter of said first and second expansion bridges and less than an inner diameter of said base pipe, wherein said first and second expansion bridges comprise a resilient material.

6. A system comprising:

a first expandable tubular section;

a first expansion bridge coupled to an inner surface of said first expandable tubular section;

a base pipe having a first end coupled to said first expandable tubular section;

a second expansion bridge coupled to an inner surface of said second expandable tubular section;

an expansion cone disposed within and translatable relative to said first expandable section, wherein said expansion cone has an expansion diameter greater than an inner diameter of said first and second expansion bridges and less than an inner diameter of said base pipe, wherein said base pipe has an inner diameter that is substantially equal to an unexpanded inner diameter of said first expandable tubular section.

7. A method comprising:

disposing an expandable system within a wellbore, wherein the expandable system includes first and second expandable tubular sections and spaced apart by a base pipe, wherein each expandable tubular section includes an expansion bridge coupled to an inner surface thereof;

expanding the first expandable tubular section into sealing engagement with the wellbore by translating an expansion cone through the first expandable tubular section so as to apply an expansion force to the expansion bridge disposed within the first expandable tubular section;

translating the expansion cone through the base pipe without expanding the base pipe; and expanding the second expandable tubular section into sealing engagement with the wellbore by translating an expansion cone through the second expandable tubular section so as to apply an expansion force to the expansion bridge disposed within the second expandable tubular section.

8. The method of claim 7 wherein the first and second expandable tubular sections sealingly engage the wellbore by compressing an external seal between an outer surface of the expandable tubular section and the wellbore.

9. The method of claim 8 wherein the external seals comprise a swellable elastomer.

10. The method of claim 7, wherein the expansion bridges comprise a resilient material.

11. The method of claim 7, wherein the expansion cone has s fixed expansion diameter.

12. The method of claim 7, wherein the base pipe has an inner diameter that is substantially equal to an unexpanded inner diameter of the expandable tubular sections.

13. The method of claim 7, wherein the base pipe has an inner diameter that is greater than an unexpanded inner diameter of the expandable tubular sections.

14. A system comprising:

a base pipe disposed within a wellbore;

an first expandable tubular section coupled to a first end of said base pipe;

a second expandable tubular section coupled to a second end of said base pipe; wherein each of said first and second expandable tubular sections further comprises an expansion bridge coupled to an inner surface of the expandable tubular section;

an expansion cone operable to radially expand each expandable tubular section and by applying an expansion force to the expansion bridge, wherein said expansion cone is longitudinally translatable through said base pipe without radially expanding the base pipe;

a first external seal coupled to an outer surface of the first expandable tubular section; and a second external seal coupled to an outer surface of the second expandable tubular section.

15. The system of claim 14 wherein said first and second external seals comprise a swellable elastomer.

16. The system of claim 14, wherein the expansion diameter of said expansion cone is fixed.

17. The system of claim 14, wherein said base pipe has an inner diameter that is greater than an unexpanded inner diameter of said first expandable tubular section.

18. A system comprising:

a base pipe disposed within a wellbore;

an first expandable tubular section coupled to a first end of said base pipe;

a second expandable tubular section coupled to a second end of said base pipe; wherein each of said first and second expandable tubular sections further comprises an expansion bridge coupled to an inner surface of the expandable tubular section; and an expansion cone operable to radially expand each expandable tubular section and by applying an expansion force to the expansion bridge, wherein said expansion cone is longitudinally translatable through said base pipe without radially expanding the base pipe, wherein said first and second expansion bridges comprise a resilient material.

* * * * *